United States Patent [19]

Lock et al.

[11] Patent Number: 4,786,973

[45] Date of Patent: Nov. 22, 1988

[54] MOUNTING SLEEVE FOR VIDEO APPARATUS DEFLECTION YOKE

[75] Inventors: Brian E. Lock, Princeton, N.J.; Mark Galambus, Indianapolis; Richard M. Leonard, Greenwood, both of Ind.

[73] Assignee: RCA Licensing Corporation, Princeton, N.J.

[21] Appl. No.: 68,643

[22] Filed: Aug. 19, 1987

[51] Int. Cl.[4] ..... H04H 5/645

[52] U.S. Cl. ..... 358/248; 335/210

[58] Field of Search ..... 353/245, 248, 249; 335/210, 212; 313/431

[56] References Cited

U.S. PATENT DOCUMENTS

| | | | |
|---|---|---|---|
| 2,643,373 | 6/1953 | Morris | 358/248 |
| 3,566,321 | 2/1971 | Brown, Jr. . | |
| 3,663,751 | 5/1972 | Oberg et al. | 358/248 |
| 3,781,730 | 12/1973 | Salners | 335/210 |
| 4,039,986 | 8/1977 | Nakazawa et al. | 335/212 |
| 4,095,260 | 6/1978 | Suzuki | 358/248 |

*Primary Examiner*—Edward L. Coles, Sr.

*Attorney, Agent, or Firm*—Paul J. Rasmussen; Joseph J. Laks; Sammy S. Henig

[57] ABSTRACT

A display system for a video apparatus includes a cathode ray tube and a deflection yoke adapted to be adhesively mounted to the cathode ray tube. A flexible sleeve is removably attached to the tube between the yoke and the tube and closely conforms to the tube contour. The yoke is adhesively mounted to the sleeve rather than directly to the tube in order to permit removal and replacement of the deflection yoke without causing damage to the tube.

9 Claims, 3 Drawing Sheets

MOUNTING SLEEVE FOR VIDEO APPARATUS DEFLECTION YOKE

This invention relates to video apparatus and, in particular, to video apparatus incorporating adhesively mounted deflection yokes.

The construction of a deflection yoke and its placement on a color cathode ray tube of a video apparatus, such as a television receiver or a computer monitor, for example, is subject to critical specifications and tolerances in order to meet the operating requirements and performance standards of the video apparatus. The placement and alignment of the deflection yoke on the cathode ray tube (CRT) of the video apparatus is determined by adjusting the position of the yoke to optimize several performance parameters, including color purity and convergence. Once the desired yoke position is attained, the yoke must be attached to the CRT in a manner that maintains the position of the yoke after the yoke holding and adjusting fixture is removed.

A typical yoke-to-CRT attachment arrangement includes a clamp near the rear of the yoke to fix its longitudinal position on the CRT neck. The front of the yoke is then adjusted by tilting to optimize, for example, electron beam convergence at the edges of the cathode ray tube display screen. The front of the deflection yoke is then fixed with respect to the CRT by inserting several rubber wedges between the yoke and the tube.

Due to the previously described individual adjustment, the position of a deflection yoke with respect to a CRT may be different for each tube-yoke combination. Therefore, exact placement of the wedges for all tube-yoke assemblies cannot be determined from a fixed reference point, making automatic insertion of wedges difficult and costly to implement. The practical solution requiring manual placement of wedges is time consuming and expensive. Additionally, the wedges may provide insufficient support for the deflection yoke, allowing shifting of the yoke position to occur when the adjustment fixture is disengaged, thereby resulting in degraded performance of the video apparatus.

The use of adhesives to attach or mount the deflection yoke to the CRT provides an effective, reliable yoke support mechanism while permitting efficient implementation of automated yoke mounting equipment. Such an arrangement is described in U.S. Pat. No. 4,616,265, issued Oct. 7, 1986, in the name of T. B. Lyden, and entitled "Deflection Yoke Assembly and Mounting Arrangement", herein incorporated by reference.

Adhesively bonding the deflection yoke directly to the glass of the CRT may place undesirable stresses on the CRT glass due to differences in the thermal expansion properties of the glass and the adhesive. Removal of the deflection yoke may also be difficult if replacement or repair of the deflection yoke is required.

In accordance with an aspect of the present invention, a display system for a video apparatus comprises a cathode ray tube incorporating a neck and funnel region. A flexible sleeve is disposed on and substantially conforms to the tube in the vicinity of the neck and funnel regions. Means removably affixes the sleeve to the tube. A deflection yoke is disposed on the tube in the vicinity of the neck and funnel regions. A quantity of adhesive is disposed between the deflection yoke and the sleeve for fixing the position of the deflection yoke with respect to the cathode ray tube.

In the accompanying drawing

Figure 1:
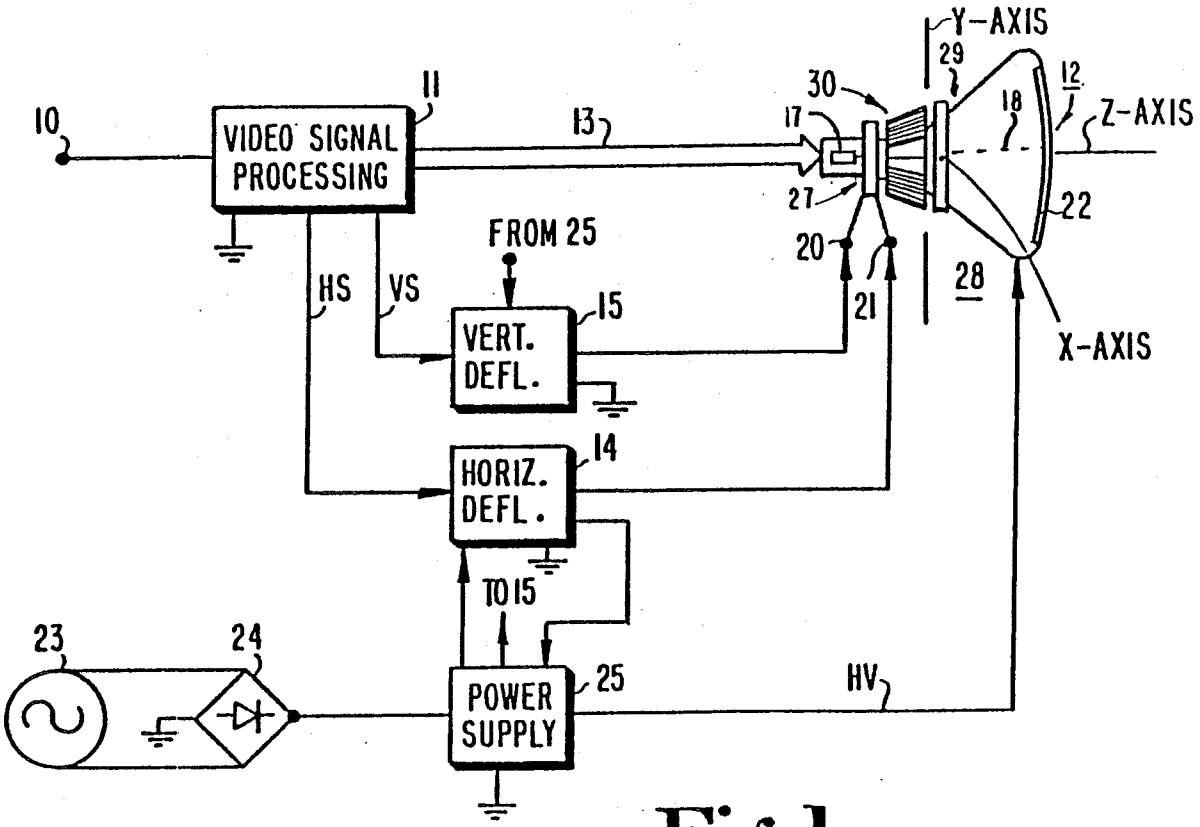
FIG. 1 is a block and schematic diagram of a portion of a video apparatus.

FIG. 1 illustrates a video apparatus in which a video signal at a terminal 10 is applied to a video signal processing circuit 11. The video signal is provided from a source of video signals (not shown), such as a television receiver tuner or an external source, such as a video cassette recorder, for example. The video signal processing circuit 11 generates electron beam drive signals and applies them via a conductor 13 to the electron gun assembly 17 locateed within the neck region 27 of a cathode ray tube (CRT) 12 in order to modulate the intensity of the electron beam or beams 18 produced by the electron gun assembly 17 in accordance with the information of the video signal.

Video signal processing circuit 11 also produces horizontal, or line-rate, and vertical, or field-rate, synchronizing signals that are applied to horizontal deflection circuit 14 and vertical deflection circuit 15, respectively, along conductors designated HS and VS. Vertical deflection circuit 15 generates vertical deflection rate signals that are applied via a terminal 20 to the vertical or field-rate deflection coils of deflection yoke 30, located on CRT 12 in the vicinity of the CRT neck region 27 and the CRT funnel region 29, in order to produce vertical deflection current in the deflection coils. Horizontal deflection circuit 14 generates horizontal deflection rate signals that are applied via a terminal 21 to the horizontal or line-rate deflection coils of yoke 30, in order to produce horizontal deflection current in the deflection coils. The combination of CRT 12 and yoke 30 form a display system 28. The horizontal and vertical deflection current flowing in yoke 30 produces electromagnetic fields that deflect or scan the electron beam or beams 18 along the tube X and Y axes, respectively, to form a raster on the phosphor display screen 22 of CRT 12.

Power for the video apparatus is provided from an AC power source 23 which is connected to a rectifying circuit 24 which produces and applies an unregulated DC voltage to a power supply circuit 25. Power supply circuit 25, illustratively of the flyback type, includes regulating circuits which act to produce regulated voltage levels that are used to provide power to horizontal deflection circuit 14 and vertical deflection circuit 15, for example. Power supply 25 also supplies high voltage of the order of 25 KV along a conductor HV to the high voltage or ultor terminal of CRT 12.

In order to achieve the desired performance requirements of display system 28 (e.g., proper purity and convergence of the electron beam images formed on display screen 22), deflection yoke 30 must be mounted and reliably held on CRT 12 in correct position. Previously described U.S. Pat. No. 4,616,265 and U.S. patent application Ser. No. 900,956, filed Aug. 27, 1986 and allowed Mar. 27, 1987 in the name of Carroll et al., and entitled "Deflection Yoke for Adhesive Assembly and Mounting", herein incorporated by reference, describe a deflection yoke and mounting arrangement that utilizes an adhesive for attaching the yoke to the CRT, thereby providing reliable mounting of the yoke while permitting increased automation potential over conventional yoke mounting techniques.

During assembly of the CRT, the CRT neck region containing the electron gum assembly is joined to the CRT funnel during a process in which the glass parts of the CRT are heated and fused together. Surface irregularities of the glass of the CRT, particularly at the previously described fusion region, may allow penetration of the yoke attachment adhesive, resulting in damage to the CRT due to the different expansion coefficients of the CRT glass and the adhesive. Direct attachment of the deflection yoke to the CRT glass surface may also make removal of the yoke, without damaging the CRT, difficult if repair, replacement or readjustment of the yoke is required.

Figure 2:
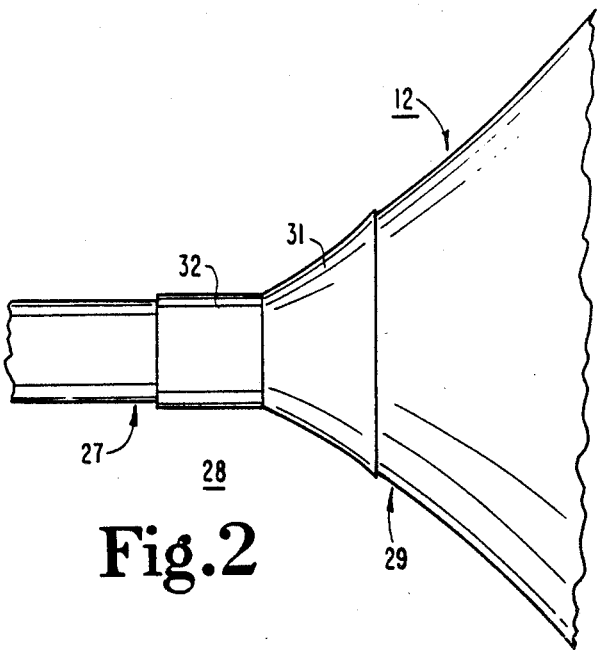
FIG. 2 is a side elevational view of a portion of a video apparatus display system in accordance with one aspect of the present invention.

In accordance with an aspect of the present invention, FIG. 2 illustrates a portion of display system 28 that incorporates a deflection yoke mounting sleeve 31, having a conical shape and comprising a flexible electrically nonconductive plastic material, such as, polyethylene terephthalate glycol for example. Sleeve 31 may be manufactured using conventional techniques, such as vacuum forming or injection molding, for example. Sleeve 31 is dimensioned to closely conform to the contour of CRT 12 in the vicinity of the neck region 27 and funnel region 29. Sleeve 31 is illustratively held in place on CRT 12 by a length of electrically nonconductive tape 32 which removably afixes the rear portion of sleeve 31 to the neck region 27 of CRT 12. As will be described in greater detail later, sleeve 31 and tape 32 encompass a sufficient surface area of CRT 12 so that the adhesive needed to mount deflection yoke 30 of display system 28 does not contact the glass surface of CRT 12. Removal of the deflection yoke may then be effected by removing tape 32 and sliding sleeve 31, with yoke attached, off CRT 12.

Figure 3:
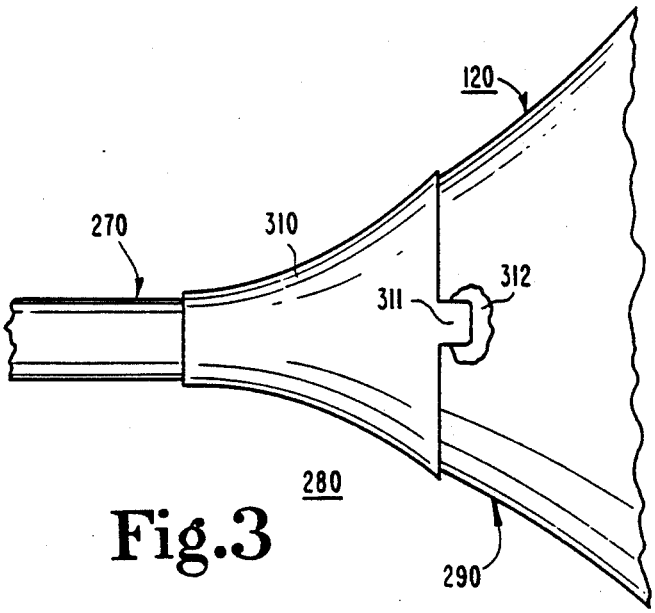
FIG. 3 is a side elevational view of a portion of a video apparatus display system in accordance with another aspect of the present invention.

FIG. 3 illustrates an alternate embodiment of a video apparatus display system 280, similar to display system 28. Display system 280 includes a deflection yoke mounting sleeve 310, having a conical shape to closely conform to the contour of CRT 12 and made of a electrically nonconductive flexible plastic material, such as Noryl®, GE's brand of synthetic thermoplastic resins. Sleeve 310 incorporates a plurality of mounting tabs 311 located at the front of sleeve 310 which are bonded to CRT 120 via a quantity of adhesive 312 in order to afix the position of sleeve 310 to CRT 120. By cutting or otherwise separating mounting tabs 311 from the remaining portion of sleeve 310, sleeve 310 and the attached deflection yoke may be easily removed from CRT 120, thereby permitting repair or replacement of the deflection yoke. Replacement of a deflection yoke would also require a replacement of the mounting sleeve, which would be positioned on CRT 120 so that the position of the mounting tabs of the replacement sleeve would not interfere with the tabs 311 remaining from sleeve 310 which would still be bonded to CRT 120.

Figure 4:
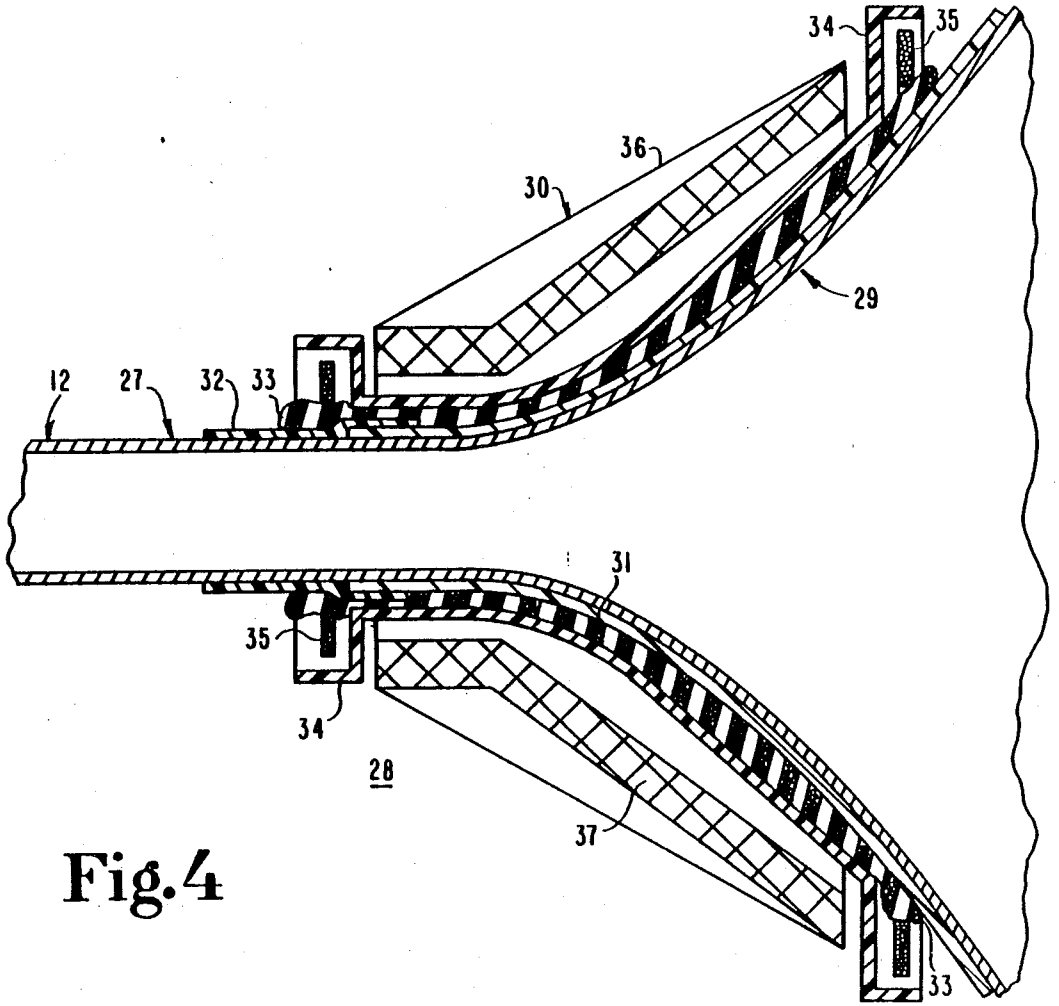
FIG. 4 is a side elevational cross-sectional view of a portion of a video apparatus display system in accordance with an aspect of the present invention.

FIG. 4 illustrates in cross section, display system 28 illustratively showing deflection yoke 30 mounted by a quantity of adhesive 33 to sleeve 31. Deflection yoke 30 illustratively comprises an electrically nonconductive plastic insulator or liner 34, saddle-wound horizontal deflection coils 35, and vertical deflection coils 36, toroidally wound on a magnetically permeable core 37. The presence of tape 32 and the pressure holding sleeve 31 against the surface of CRT 12 exerted by the presence of adhesive 33 is sufficient to reliably maintain the desired position of deflection yoke 30 in place on CRT 12. During assembly of display system 28, deflection yoke 30 is held and its position adjusted by external means (not shown), such as a yoke adjustment fixture, in order to achieve optional performance from the yoke and CRT combination. When the desired position of the yoke 30 is attached, a quantity of adhesive 33 is dispensed, such as is described in the previously identified U.S. Pat. No. 4,616,265 and U.S. patent application Ser. No. 900,956, in order to attach yoke 30 to sleeve 31. The resulting arrangement reliably maintains yoke 30 in position, yet permits removal of yoke 30, if necessary, without damaging CRT 12.

What is claimed is:

1. A display system for a video apparatus comprising:

a cathode ray tube incorporating a neck and funnel region;

a flexible sleeve disposed on and substantially conforming to said cathode ray tube in the vicinity of said neck and funnel regions;

means for removably afixing said sleeve to said cathode ray tube;

a deflection yoke disposed on said cathode ray tube in the vicinity of said neck and funnel regions; and a quantity of adhesive disposed between said deflection yoke and said sleeve for fixing the position of said deflection yoke with respect to said cathode ray tube.

2. The arrangement defined in claim 1, wherein said sleeve is electrically nonconductive.

3. The arrangement defined in claim 1, wherein said means for removably afixing said sleeve comprises electrically nonconductive tape.

4. The arrangement defined in claim 3, wherein said tape is disposed in the vicinity of said neck portion of said cathode ray tube.

5. The arrangement defined in claim 1, wherein said means for removably afixing said sleeve comprises adhesive.

6. The arrangement defined in claim 5, wherein said sleeve incorporates a plurality of tabs located in the vicinity of said funnel region of said cathode ray tube, and wherein said adhesive for afixing said sleeve is disposed in the vicinity of said tabs.

7. The arrangement defined in claim 6, wherein said tabs are separable from said sleeve for removing said sleeve from said cathode ray tube.

8. The arrangement defined in claim 1, wherein said sleeve comprises a plastic material.

9. The arrangement defined in claim 1, wherein said sleeve acts as a barrier to prevent contact of said quantity of adhesive with the surface of said cathode ray tube.

* * * * *